US012703923B2

(12) United States Patent
Sato et al.

(10) Patent No.: US 12,703,923 B2
(45) Date of Patent: Aug. 11, 2026

(54) CATHODE ELECTRODE FOR GAS DIFFUSION ELECTROLYTIC FLOW CELL, AND GAS DIFFUSION ELECTROLYTIC FLOW CELL

(71) Applicant: KABUSHIKI KAISHA TOYOTA CHUO KENKYUSHO, Nagakute (JP)

(72) Inventors: Shunsuke Sato, Nagakute (JP); Keita Sekizawa, Nagakute (JP)

(73) Assignee: KABUSHIKI KAISHA TOYOTA CHUO KENKYUSHO, Nagakute (JP)

( * ) Notice: Subject to any disclaimer, the term of this patent is extended or adjusted under 35 U.S.C. 154(b) by 769 days.

(21) Appl. No.: 17/869,020

(22) Filed: Jul. 20, 2022

(65) Prior Publication Data

US 2023/0027171 A1 Jan. 26, 2023

(30) Foreign Application Priority Data

Jul. 26, 2021 (JP) ..... 2021-121815

(51) Int. Cl.

| | |
|---|---|
| ***C25B 11/091*** | (2021.01) |
| ***C25B 1/23*** | (2021.01) |
| ***C25B 3/00*** | (2021.01) |
| ***C25B 3/25*** | (2021.01) |
| ***C25B 3/26*** | (2021.01) |
| ***C25B 11/032*** | (2021.01) |

(52) U.S. Cl.

CPC ..... *C25B 11/091* (2021.01); *C25B 1/23* (2021.01); *C25B 3/00* (2013.01); *C25B 3/25* (2021.01); *C25B 3/26* (2021.01); *C25B 11/032* (2021.01)

(58) Field of Classification Search

CPC ..... C25B 11/091; C25B 1/23; C25B 3/26; C25B 3/25; C25B 3/00; C25B 11/032

See application file for complete search history.

(56) References Cited

U.S. PATENT DOCUMENTS

| | | | | |
|---|---|---|---|---|
| 2016/0251766 | A1 | 9/2016 | Masel et al. | |
| 2016/0369415 | A1 | 12/2016 | Masel et al. | |
| 2023/0416933 | A1 * | 12/2023 | Sato | C25B 9/60 |

FOREIGN PATENT DOCUMENTS

| | | | |
|---|---|---|---|
| JP | 2017-171963 | A | 9/2017 |
| JP | 2019-510884 | A | 4/2019 |
| JP | 2019-127646 | A | 8/2019 |
| WO | 2017/176306 | A1 | 10/2017 |

OTHER PUBLICATIONS

Berlinguette et al., "Electrolysis of Gaseous CO2 to CO in a Flow Cell with a Bipolar Membrane", ACS Energy Lett. 2018, 3, 149-154 (Year: 2017).*

(Continued)

*Primary Examiner* — James Lin
*Assistant Examiner* — Kevin Sylvester
(74) *Attorney, Agent, or Firm* — Oliff PLC

(57) ABSTRACT

A cathode electrode for a gas diffusion electrolytic flow cell that produces a carbon dioxide reduction product by reducing carbon dioxide, wherein the cathode electrode comprises a catalyst layer having a metal complex catalyst, a carbon material and an alkali metal salt, and a gas diffusion layer disposed on the catalyst layer.

6 Claims, 5 Drawing Sheets

(56) References Cited

OTHER PUBLICATIONS

Cao et al., "Alkali metal cation effects on the electrocatalytic CO2 reduction with iron porphyrins", Chinese J. Catalysis 2021, 42, 1439-1444. (Available online May 5, 2021) (Year: 2021).*
Hammouche et al., "Chemical Catalysis of Electrochemical Reactions, Homogeneous Catalysis of the Electrochemical Reduction of Carbon Dioxide by Iron Porphyrins: Role of the Addition of Magnesium Cations", J. Am. Chem. Soc. 1991, 113, 8455-8466. (Year: 1991).*
Mishra et al., "Recent advances in the catalytic fixation of carbon dioxide to value-added chemicals over alkali metal salts" J. CO2 Utilization 2020, 41, 101252 (Year: 2020).*
Newman et al., "Design of an Electrochemical Cell Making Syngas [CO + H2] from CO2 and H2O Reduction at Room Temperature", J. Electrochem. Soc. 2008, 155, B42-B49. (Year: 2008).*
Lieber et al. ("Catalytic Reduction of CO2 at Carbon Electrodes Modified with Cobalt Phthalocyanine," J. Am. Chem. Soc. 1984, 106 , 5033-5034). (Year: 1984).*
Gu et al. ("Modulating Electric Field Distribution by Alkali Cations for CO2 Electroreduction in Strongly Acidic Medium," Version 1, ChemRxiv, p. 1-45, available online Jul. 9, 2021, DOI://10.26434/chemrxiv-2021-zgq9k). (Year: 2021).*
Ren et al. (Molecular electrocatalysts can mediate fast, selective CO2 reduction in a flow cell, Science 2019, 365, 367-369 and supporting information, p. 1-19). (Year: 2019).*
Sato et al. ("Low-Energy Electrocatalytic CO2 Reduction in Water over Mn-Complex Catalyst Electrode Aided by a Nanocarbon Support and K+ Cations," ACS Catal. 2018, 8, 445-4458). (Year: 2018).*
Zhang et al. ("Two-Dimensional Metal-Organic Framework Nanosheets with Cobalt-Porphyrins for High-Performance CO2 Electroreduction," Chem. Eur. J. 2020, 26, 1604-1611). (Year: 2019).*
Melo et al. ("Carbon Dioxide to Methane Using Ruthenium Nanoparticles: Effect of the Ionic Liquid Media," ACS Sustainable Chem. Eng. 2019, 7, 11963-11969). (Year: 2019).*
Mineo et al. ("Very fast CO2 response and hydrophobic properties of novel poly(ionic liquid)s," J. Mater. Chem. 2009, 19, 8861-8870). (Year: 2009).*
Huang et al. ("CO2 electrolysis to multicarbon products in strong acid," Science 2021, 372, 1074-1078). (Year: 2021).*
Huang et al. ("CO2 electrolysis to multicarbon products in strong acid," Science 2021, 372, supporting information). (Year: 2021).*
Cheng, Wen-Hui et al., "CO2 Reduction to CO with 19% Efficiency in a Solar-Driven Gas Diffusion Electrode Flow Cell under Outdoor Solar Illumination," ACS Energy Letters, pp. 470-476, 2020.
Sato, Shunsuke et al., "Low-Energy Electrocatalytic CO2 Reduction in Water over Mn-Complex Catalyst Electrode Aided by a Nanocarbon Support and K+ Cations" ACS Catalysis, pp. 4452-4458, 2018.
Arai, Takeo et al., "Solar-driven CO2 to CO reduction utilizing H2O as an electron donor by earth-abundant Mn-bipyridine complex and Ni-modified Fe-oxyhydroxide catalysts activated in a single-compartment reactor," ChemComm, Vo. 55, pp. 237-240, 2019.
Ren, Shaoxuan et al., "Molecular electrocatalysts can mediate fast, selective CO2 reduction in a flow cell," Science 365, pp. 367-369, 2019.

* cited by examiner

CATHODE ELECTRODE FOR GAS DIFFUSION ELECTROLYTIC FLOW CELL, AND GAS DIFFUSION ELECTROLYTIC FLOW CELL

CROSS REFERENCE TO RELATED APPLICATION

This application claims priority to Japanese Patent Application No. 2021-121815 filed on Jul. 26, 2021, which is incorporated herein by reference in its entirety including the specification, claims, drawings, and abstract.

TECHNICAL FIELD

The present disclosure relates to a cathode electrode for a gas diffusion electrolytic flow cell, and to a gas diffusion electrolytic flow cell

BACKGROUND

In recent years, the depletion of fossil fuels such as oil and coal has become a concern, and the expectations for renewable energy that can be used sustainably continue to increase. Due to these types of energy concerns, and also from the viewpoint of other environmental issues and the like, the development of artificial photosynthesis technology, which uses renewable energy such as sunlight to electrochemically reduce carbon dioxide and generate a storable chemical energy source, is being actively pursued.

One known method for reducing carbon dioxide involves electrochemically reducing carbon dioxide that has been dissolved in an aqueous solution (for example, see JP 2017-171963 A, JP 2019-127646 A, Arai, T.; Sato, S.; Sekizawa, K.; Suzuki T. M.; Morikawa, T., "Solar-driven $CO_2$ to CO reduction utilizing $H_2O$ as an electron donor by earth-abundant Mn-bipyridine complex and Ni-modified Fe-oxyhydroxide catalysts activated in a single-compartment reactor", Chem. Commun., Vol. 55, (2019), pp. 237 to 240, and S. Sato, et al., ACS Catal. 2018, 8, 4452 to 4458). The publication by S. Sato et al. shows clearly that a difference in the carbon dioxide reduction performance develops depending on the existence or absence of potassium ions in the aqueous solution.

However, because the concentration of carbon dioxide that can be dissolved in an aqueous solution at room temperature and normal pressure is low, reduction of coexistent protons ($H^+$) to produce a by-product of hydrogen ($H_2$) tends to occur preferentially to the carbon dioxide reduction. Further, because the mass diffusivity of carbon dioxide in aqueous solutions is slow, the theoretical limit for the reaction current density of the carbon dioxide reduction is a small value of $<30\ mA \cdot cm^{-2}$.

One method that has proposed to address these problems is the gas diffusion electrolytic flow cell, in which carbon dioxide gas is supplied directly to the cathode catalyst layer (for example, see JP 2019-510884, Ren, S.; Joulie, D.; Salvatore, D.; Torbensen, K.; Wang, M.; Robert, M.; Berlinguette, C. P., "Molecular electrocatalysts can mediate fast, selective $CO_2$ reduction in a flow cell", Science, Vol. 365, No. 6451 (2019), pp. 367 to 369, and Cheng, W.-H.; Richter, M. H.; Sullivan, I.; Larson, D. M.; Xiang, C.; Brunschwig, B. S.; Atwater, H. A., "$CO_2$ Reduction to CO with 19% Efficiency in a Solar-Driven Gas Diffusion Electrode Flow Cell under Outdoor Solar Illumination", ACS Energy Letters, Vol. 5, (2020), pp. 470 to 476).

In the case of a gas diffusion electrolytic flow cell, the concentration ratio of $CO_2$ relative to water is large, and therefore side production of $H_2$ is suppressed, and the reaction proceeds in the gas phase where the diffusion rate is high, meaning the reaction current density limit increases dramatically. As a result, it is known that when a high cell potential is applied, a large reaction current density is generated, and the carbon dioxide reduction product can be obtained with high selectivity.

Furthermore, in gas diffusion electrolytic flow cells, the anode and the cathode are separated by an ion-conductive polymer membrane, which offers the advantage that the oxidation product from the anode and the carbon dioxide reduction product from the cathode can be obtained without mixing.

SUMMARY

However, in conventional gas diffusion electrolytic flow cells, due to factors such as a large reaction overpotential for the anode and/or cathode, obtaining a carbon dioxide reduction product at a low cell potential is problematic.

Accordingly, an object of the present disclosure is to provide a cathode electrode for a gas diffusion electrolytic flow cell and a gas diffusion electrolytic flow cell that can yield a carbon dioxide reduction product at a low cell potential.

The present disclosure provides a cathode electrode for a gas diffusion electrolytic flow cell that produces a carbon dioxide reduction product by reducing carbon dioxide, wherein the cathode electrode comprises a catalyst layer having a metal complex catalyst, a carbon material and an alkali metal salt, and a gas diffusion layer disposed on the catalyst layer.

Further, in the above cathode electrode for a gas diffusion electrolytic flow cell, the alkali metal salt may include a potassium salt.

Furthermore, the present disclosure also provides a gas diffusion electrolytic flow cell comprising an anode electrode that produces oxygen by oxidizing water or hydroxide ions, a cathode electrode that produces a carbon dioxide reduction product by reducing carbon dioxide, and an ion-conductive polymer membrane that is sandwiched between the anode electrode and the cathode electrode, wherein the cathode electrode comprises a catalyst layer and a gas diffusion layer in that order from the side of the ion-conductive polymer membrane, and the catalyst layer has a metal complex catalyst, a carbon material and an alkali metal salt.

Further, in the above gas diffusion electrolytic flow cell, the alkali metal salt may include a potassium salt.

By employing the present disclosure, a cathode electrode for a gas diffusion electrolytic flow cell and a gas diffusion electrolytic flow cell can be provided that can produce a carbon dioxide reduction product at a low cell potential.

BRIEF DESCRIPTION OF DRAWINGS

Embodiment(s) of the present disclosure will be described based on the following figures, wherein.

DESCRIPTION OF EMBODIMENTS

Embodiments of the present disclosure are described below. However, these embodiments are merely examples of implementing the present disclosure, and the present disclosure is not limited to these embodiments.

Figure 1:
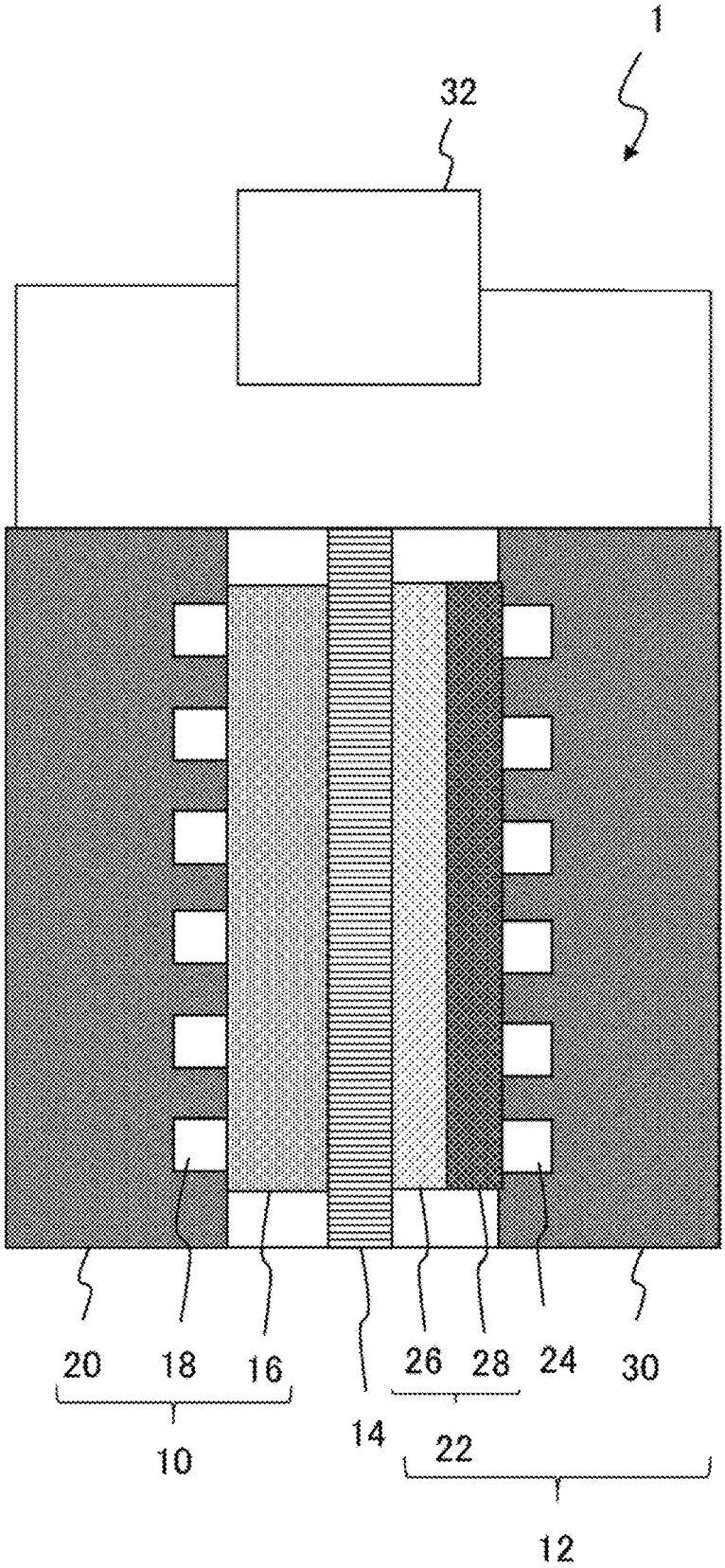
FIG. 1 is a schematic structural diagram illustrating one example of a gas diffusion electrolytic flow cell according to an embodiment of the present disclosure.

FIG. 1 is a schematic structural diagram illustrating one example of a gas diffusion electrolytic flow cell according to an embodiment of the present disclosure. The gas diffusion electrolytic flow cell 1 illustrated in FIG. 1 is a device in which a carbon dioxide gas is supplied directly to a cathode electrode 22. The carbon dioxide gas is a gas which contains carbon dioxide, and may be a gas containing carbon dioxide and water vapor. The gas diffusion electrolytic flow cell 1 illustrated in FIG. 1 comprises an anode section 10, a cathode section 12, and an ion-conductive polymer membrane 14. The anode section includes an anode electrode 16 and an anode solution flow channel 18. The anode electrode 16 is disposed between, and in contact with, the ion-conductive polymer membrane 14 and the anode solution flow channel 18. The anode solution flow channel 18 supplies the anode solution to the anode electrode 16, and is formed from pits (grooves or recesses) provided in an anode collector 20. The cathode section 12 includes the cathode electrode 22 and a gas flow channel 24. The cathode electrode 22 is disposed between the gas flow channel 24 and the ion-conductive polymer membrane 14. The cathode electrode 22 comprises a catalyst layer 26 and a gas diffusion layer 28 in that order from the side of the ion-conductive polymer membrane 14. The gas flow channel 24 supplies the carbon dioxide gas to the cathode electrode 22, and is formed from pits (grooves or recesses) provided in a cathode collector 30. The ion-conductive polymer membrane 14 is sandwiched between the anode electrode 16 and the cathode electrode 22. In other words, the anode electrode 16 and the cathode electrode 22 are separated by the ion-conductive polymer membrane 14.

A solution inlet and a solution outlet (neither of which is shown in the drawing) are, for example, connected to the anode collector 20. The anode solution passes through the solution inlet and is introduced into the anode solution flow channel 18, flows through the inside of the anode solution flow channel 18 while contacting the anode electrode 16, and is then discharged from the anode solution outlet. The anode collector 20 uses, for example, a material that exhibits low chemical reactivity and high conductivity. Examples of such materials include metal materials such as Ti and SUS, as well as carbon and the like.

A gas inlet and a gas outlet (neither of which is shown in the drawings are, for example, connected to the cathode collector 30, The carbon dioxide gas passes through the gas inlet and is introduced into the gas flow channel 24, flows through the inside of the gas flow channel 24 while contacting the catalyst layer 26 via the gas diffusion layer 28, and is then discharged from the gas outlet. In a similar manner to the anode collector 20, the cathode collector 30 uses, for example, a material that exhibits low chemical reactivity and high conductivity. Examples of such materials include metal materials such as Ti and SUS, as well as carbon and the like.

Symbol 32 shown in FIG. 1 is a power source, which is connected electrically between the anode electrode 16 and the cathode electrode 22, and supplies electric power. There are no particular limitations on the power source 32, and examples include chemical cells (including primary cells and secondary cells), constant voltage sources, and solar cells. By using a solar cell as the power source 32, an artificial photosynthesis device can be produced comprising the gas diffusion electrolytic flow cell 1, and a solar cell which produces electric power for supply to the anode electrode 16 and the cathode electrode 22. An artificial photosynthesis device according to an embodiment of the present disclosure is driven using sunlight as the energy source, with the anode electrode 16 and the cathode electrode 22 of the gas diffusion electrolytic flow cell 1 connected via a solar cell.

Next is a description of an operational example of the gas diffusion electrolytic flow cell 1 illustrated in FIG. 1. The description here focuses mainly on the case where carbon monoxide (CO) is produced by carbon dioxide reduction, but the carbon dioxide reduction product is not limited to carbon monoxide, and may also be, for example, methane ($CH_4$), ethane ($C_2H_6$), or ethylene ($C_2H_4$) or the like. Further, in terms of the reaction process, a process in which mainly hydrogen ions ($H^+$) are produced, and a process in which mainly hydroxide ions ($OH^-$) are produced are considered, although the present disclosure is not limited to either of these reaction processes.

First, the reaction process when mainly water ($H_2O$) is oxidized to produce hydrogen ions ($H^+$) is discussed. When an electric current is supplied between the anode electrode 16 and the cathode electrode 22 from the power source 32, an oxidation reaction of water ($H_2O$) occurs at the anode electrode 16 contacting the anode solution. Specifically, as shown in formula (1) below, the $H_2O$ contained in the anode solution is oxidized, producing oxygen ($O_2$) and hydrogen ions (W).

$$2H_2O \rightarrow 4H^+ + O_2 + 4e^- \quad (1)$$

At the cathode electrode 22, the carbon dioxide gas supplied from the gas flow channel 24 to the catalyst layer 26 via the gas diffusion layer 28 is reduced by the electrons ($e^-$) based on the current supplied to the cathode electrode 22 from the power source 32, and, for example, the $H^+$ ions that have migrated from the anode electrode 16 to the side of the cathode electrode 22 via the ion-conductive polymer membrane 14, producing CO as shown below in formula (2). Further, as a side reaction, hydrogen ions receive electrons to produce hydrogen, as shown below in formula (3). At this time, the hydrogen may be produced simultaneously with the carbon monoxide.

$$CO_2 + 2H^+ + 2e^- \rightarrow CO + H_2O \quad (2)$$

$$2H^+ + 2e^- \rightarrow H_2 \quad (3)$$

Next, the reaction process when mainly carbon dioxide ($CO_2$) is reduced to produce hydroxide ions ($OH^-$) is discussed. When an electric current is supplied between the anode electrode 16 and the cathode electrode 22 from the power source 32, at the cathode electrode 22, the carbon dioxide gas (containing water vapor) supplied from the gas flow channel 24 to the catalyst layer 26 via the gas diffusion layer 28 is reduced as shown below in formula (4), producing carbon monoxide (CO) and hydroxide ions ($OH^+$). Further, as a side reaction, water receives electrons to produce hydrogen, as shown below in formula (5). At this time, the hydrogen may be produced concurrently with the carbon monoxide. The hydroxide ions ($OH^-$) produced by these reactions, for example, migrate through the ion-conductive polymer membrane 14 to the side of the anode electrode 16 where, as shown below in formula (6), the hydroxide ions ($OH^-$) are oxidized to produce oxygen ($O_2$).

$$2CO_2+2H_2O+4e^- \rightarrow 2CO+4OH^- \quad (4)$$

$$2H_2O+2e^- \rightarrow H_2+2OH^- \quad (5)$$

$$4OH^- \rightarrow 2H_2O+O_2+4e^- \quad (6)$$

The structures of the anode electrode 16, the cathode electrode 22 and the ion-conductive polymer membrane 14 are described below in further detail.

As described above, the anode electrode 16 is an electrode (oxidation electrode) which promotes the oxidation reaction of water ($H_2O$) in the anode solution to produce oxygen ($O_2$) and hydrogen ions ($H^+$), or promotes the oxidation reaction of hydroxide ions ($OH^-$) generated in the cathode section 12 to produce oxygen and water.

In terms of enabling a reduction in the overpotential of the oxidation reaction, the anode electrode 16 may contain a substrate composed of at least one material selected from the group consisting of Ni, Ti, Fe and C. The Ni, Ti and Fe metal materials also include alloys containing at least one metal among Ni, Ti and Fe. Further, the substrate has a structure which, for example, enables the migration of the anode solution or ions between the ion-conductive polymer membrane 14 and the anode solution flow channel 18, such as a porous body, a mesh, or a fibrous sintered body.

The anode electrode 16 includes, for example, an anode catalyst. In terms of being capable of reducing the overpotential of the oxidation reaction, examples of the anode catalyst include metals containing at least one element selected from the group consisting of Ni, Fe, Co, Mn, Ru and Ir, oxides containing these metals, hydroxides containing these metals, and oxyhydroxides containing these metals. One of these anode catalysts may be used alone, or a combination of two or more catalysts may be used. In those cases where an anode catalyst is used, the anode catalyst may be supported on the substrate mentioned above.

In terms of enhancing the oxidation reaction, the anode solution includes, for example, at least one type of ion selected from the group consisting of hydroxide ions, bicarbonate ions, carbonate ions, chloride ions, bromide ions, iodide ions, nitrate ions, sulfate ions, phosphate ions, borate ions, tetraborate ions, hydrogen ions, lithium ions, sodium ions, potassium ions, rubidium ions and cesium ions.

There are no particular limitations on the gas diffusion layer 28 that constitutes part of the cathode electrode 22, provided the gas diffusion layer 28 ensures favorable electrical continuity between the catalyst layer 26 and the power source 32, and supplies carbon dioxide gas efficiently to the catalyst layer 26, but in terms of being capable of reducing the amount of water migrating from the side of the cathode electrode 22, a hydrophobic porous carbon base material, for example, may be used.

As described above, the catalyst layer 26 that constitutes part of the cathode electrode 22 promotes the reduction reaction of carbon dioxide in the carbon dioxide gas, producing a carbon dioxide reduction product or the like. The catalyst layer 26 contains a metal complex catalyst, a carbon material, and an alkali metal salt. Further, the catalyst layer 26 may also contain, for example, a polymer that functions as an ion conductor and a binder. In terms of properties such as improving the diffusibility of the carbon dioxide gas, the catalyst layer 26 may employ, for example, a porous structure. The thickness of the catalyst layer 26 is, for example, from 5 to 200 μm.

The metal complex catalyst has a central metal and a ligand. There are no particular limitations on the central metal, provided it is a metal that catalyzes a reduction reaction of carbon dioxide, but for example, in terms of being capable of reducing the overpotential in the carbon dioxide reduction reaction, at least one metal selected from the group consisting of Mn, Fe, Co, Ni, Cu, Mo, Ru and Re may be used, or Co, Mn or Ru may be used. Examples of the ligand include bidentate ligands having a structure such as that of 2,2'-bipyridine, 2-phenylpyridine and 1,10-phenanthroline, tridentate ligands having a structure such as that of 2,2':6',2"-tetpyridine, tetradentate ligands having a structure such as that of porphyrin, phthalocyanine, corrole, chlorin and 2,2':6',2":6",2'"-quaterpyridine, and pentadentate or higher ligands having one of these tetradentate or lower ligands as a base structure, with a coordinating substituent such as a pyridine linked organically to this base structure.

Examples of specific metal complex catalysts include Co complex catalysts having a phthalocyanine analog structure (formula (1) shown below: cobalt tetrapyridino-porphyrazine, and formula (2) shown below: cobalt phthalocyanine), and Mn complex catalysts having a 2,2'-bipyridine structure (formula (3) shown below: Mn{4,4'-di(1H-1-pyrrolylpropyl carbonate)-2,2'-bipyridine}$(CO)_3(MeCN)^+$).

[Chemical formula 1]

(1)

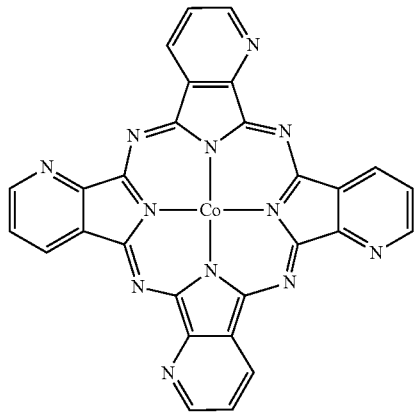

-continued (2)

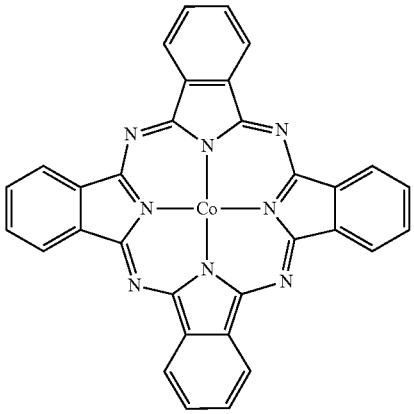

(3)

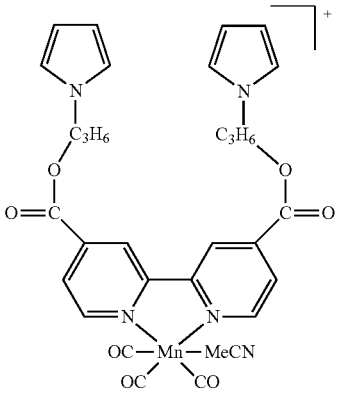

Examples of the carbon material contained in the catalyst layer 26 include carbon blacks such as Ketjen Black and Vulcan (a registered trademark) XC-72, activated carbon, and carbon nanotubes and the like. The carbon material is for example, used as a carrier for supporting the metal complex catalyst described above. By supporting the metal complex catalyst on the carbon material, the reduction reactivity, for example, can be enhanced.

The alkali metal salt contained in the catalyst layer 26 may be an inorganic alkali metal salt, an organic alkali metal salt, or a combination of both these types.

Examples of inorganic alkali metal salts that may be used include various inorganic salts of the alkali metals such as lithium, sodium, potassium, rubidium and cesium, and specific examples include the chlorides, nitrates, carbonates, sulfates, phosphates and hydroxides of these alkali metals. Further, layered compounds typified by clay that contain alkali metals may also be used.

Examples of the organic alkali metal salts include alkali metal salts of aliphatic organic acids such as alkali metals salts of aliphatic sulfonic acids, and alkali metal salts of aromatic organic acids such as alkali metals salts of aromatic sulfonic acids. Examples of alkali metals salts of aliphatic sulfonic acids include alkali metal alkanesulfoantes. Specific examples of the alkanesulfonic acids used in these alkali metal alkanesulfoantes include methanesulfonic acid, ethanesulfonic acid, propanesulfonic acid, butanesulfonic acid, methylbutanesulfonic acid, hexanesulfonic acid, heptanesulfonic acid and octanesulfonic acid, and one of these acids may be used alone, or a combination of two or more acids may be used. Further, alkali metal salts in which a portion or all of the alkyl group has been substituted with fluorine atoms may also be used. Moreover, examples of the aromatic sulfonic acids used in alkali metal aromatic sulfonates include sulfonic acids of monomer-based or polymer-based aromatic sulfides, sulfonic adds of aromatic carboxylic acids or esters thereof, and sulfonic acids of monomer-based or polymer-based aromatic ethers, and one of these acids may be used alone, or a combination of two or more acids may be used. For example, an organic alkali metal salt that is readily soluble in alcohol may be used as the alkali metal salt. By using an alcohol solvent containing a dissolved organic alkali metal salt, the organic alkali metal salt can be highly dispersed within the catalyst layer 26.

The amount of the alkali metal salt, for example, relative to the total mass of carbon material used in the catalyst layer 26, may be within a range from 5% by mass to 50% by mass.

Examples of the polymer that functions as an ion conductor and a binder within the catalyst layer 26 include cation exchange resin such as Nafion (a registered trademark) (manufactured by DuPont de Nemours, Inc.) and Flemion (manufactured by AGC Inc.), and anion exchange resins such as Neosepta, Selemion and Sustainion.

The carbon dioxide reduction product produced by the carbon dioxide reduction reaction includes, for example, at least one substance selected from the group consisting of carbon monoxide, methane, ethane and ethylene. In embodiments of the present disclosure, besides the above substances, other compounds such as formic acid, methanol, ethanol, formaldehyde, and ethylene glycol and the like may also sometimes be produced.

In terms of enhancing the catalytic activity, the catalyst layer 26 may also contain a phenol or a salt thereof. Further, in terms of factors such as enabling the oxidation of water to proceed at a lower potential, the anode electrode 16 may also contain iron oxyhydroxide or nickel oxyhydroxide.

Examples of membranes that may be used as the ion-conductive polymer membrane 14 include cation exchange membranes such as Nafion and Flemion, and anion exchange membranes such as Neosepta, Selemion and Sustainion. In those cases where an alkaline aqueous solution is used as the anode solution, and the migration of mainly hydroxide ions ($OH^-$) is assumed, the ion-conductive polymer membrane 14 is formed, for example, from an anion exchange membrane.

By using the cathode 22 of an embodiment of the present disclosure, a carbon dioxide reduction product can be obtained at a low cell potential. Thee surmised reasons for this effect are presented below.

By including an alkali metal salt in the catalyst layer 26, as in the cathode electrode 22 of an embodiment of the present disclosure, when the metal complex catalyst reacts with $CO_2$, because the alkali metal salt (or alkali metal ions) adsorbs specifically to the oxygen side of the $CO_2$, lowering the activation energy, the overpotential due to the $CO_2$ reduction reaction is lowered, and carbon dioxide electrolysis can occur at a lower cell potential to yield a carbon dioxide reduction product. Further, as a result of the alkali metal salt (or alkali metal ions) adsorbing specifically to the oxygen side of the $CO_2$, oxidation of the metal complex catalyst by $CO_2$ is suppressed, and an improvement in the durability of the metal complex catalyst is sometimes observed. For example, Co complex catalysts having a phthalocyanine structure are prone to oxidation by $CO_2$, but by also including an alkali metal salt, oxidation of these Co complex catalysts having a phthalocyanine structure can be suppressed, enabling an improvement in catalyst durability.

Further, compared with methods in which carbon dioxide that is dissolved in an aqueous solution is electrochemically reduced, the gas diffusion electrolytic flow cell 1 of an embodiment of the present disclosure enables a larger $CO_2$ concentration ratio relative to water, and therefore side production of $H_2$ can be suppressed, and because reaction proceeds in the gas phase where the diffusion rate is high, the reaction current density limit can be increased. Accordingly, a large reaction current density can be generated, and a carbon dioxide reduction product can be obtained.

Furthermore, the gas diffusion electrolytic flow cell 1 of an embodiment of the present disclosure can achieve production of carbon monoxide or formic acid or the like by carbon dioxide electrolysis at a cell potential of, for example, less than 2.0 V, not more than 1.7 V, or even 1.5 V or less. This reduction in the cell potential yields an increase in the energy conversion efficiency for the conversion of electrical energy into chemical energy. In other words, this means the energy loss during cell operation is reduced. For example, when CO is produced by carbon dioxide electrolysis at a cell potential of 1.9 V, the energy conversion efficiency is equivalent to 67%, but when CO is produced by carbon dioxide electrolysis at a cell potential of 1.5 V the energy conversion efficiency reaches 90%. Accordingly, by using the gas diffusion electrolytic flow cell 1 provided with the cathode electrode 22 of an embodiment of the present disclosure, electrical energy can be converted at high efficiency into storable chemical energy such as carbon monoxide or formic acid.

Further, provided carbon dioxide reduction is achievable at a low cell potential, the cell is also effective in artificial photosynthesis devices in combination with a solar cell. In conventional artificial photosynthesis devices, because a cell potential exceeding 2 V is necessary for carbon dioxide electrolysis, solar cells having a large open circuit voltage have been necessary. As a result, it has been necessary to either use a GaInP/GaInAs/Ge triple junction solar cell designed for space applications, which has a large open circuit voltage (approximately 2.7 V) but is very expensive, or use six polycrystalline silicon solar cells that are inexpensive but have a small open circuit voltage (approximately 0.5 V) in a series connection. Practical application of the former solar cell is difficult from the viewpoint of the resources used, whereas the latter solar cell requires a large number of series-connected cells, and therefore the current density falls, and the energy conversion efficiency decreases. However, by using the gas diffusion electrolytic flow cell 1 provided with the cathode electrode 22 of an embodiment of the present disclosure, carbon dioxide electrolysis is possible at a cell potential of less than 2.0 V, and therefore the device can be driven with only three or four polycrystalline silicon solar cells connected in series, which is not only practical from a cost perspective, but also enables an artificial photosynthesis device that exhibits high energy conversion efficiency to be constructed.

In terms of configurations that enable the cell potential in a gas diffusion electrolytic flow cell to be reduced, in addition to reduction in the overpotential due to the carbon dioxide reduction reaction, another possible configuration involves reducing the overpotential for the oxidation of water or hydroxide ions. As described above, for example, techniques that may be used to reduce the overpotential for the oxidation of water or hydroxide ions include using a substrate composed of at least one material selected from the group consisting of Ni, Ti, Fe and C in the anode electrode 16, and using metals containing at least one element selected from the group consisting of Ni, Fe, Co, Mn, Ru. and Ir, oxides containing these metals, hydroxides containing these metals, or oxyhydroxides containing these metals as the anode catalyst.

In those cases where the carbon dioxide reduction reaction is a reaction between carbon dioxide and hydrogen ions, although the cathode electrode 22 side requires an appropriate level of hydrogen ion concentration, if the hydrogen ion concentration is too high, then side production of $H_2$ tends to progress more readily, and therefore the liquid characteristics on the side of the cathode electrode 22 is typically between neutral and slightly alkaline. On the other hand, in terms of, for example, reducing the overpotential and increasing the reaction current, the liquid characteristics on the side of the anode electrode 16 are typically alkaline. In an embodiment of the present disclosure, by supplying a carbon dioxide gas containing neutral water vapor to the side of the cathode electrode 22, and supplying an alkaline anode solution to the side of the anode electrode 16, the liquid characteristics of the cathode electrode 22 side can be set to a neutral level (for example, pH 6 to 8), while the liquid characteristics of the anode electrode 16 side can be made alkaline. When carbon dioxide and water are coexistent, in those cases where carbonic acid is produced, this carbonic acid can sometimes cause the liquid characteristics to alter from neutral to acidic, but in an embodiment of the present disclosure, because the anode section 10 and the cathode section 12 are separated by the ion-conductive polymer membrane 14, neutralization of the alkaline anode solution by carbon dioxide is prevented, and the liquid characteristics of the anode electrode 16 side can be maintained in an alkaline state.

Moreover, by supplying a carbon dioxide gas containing neutral water vapor to the side of the cathode electrode 22 and supplying an alkaline anode solution to the side of the anode electrode 16, thereby making the liquid characteristics of the anode electrode 16 side alkaline and the liquid characteristics of the cathode electrode 22 side neutral, a hydrogen ion concentration difference is formed between the anode section 10 and the cathode section 12 with the ion-conductive polymer membrane 14 disposed therebetween. It is thought that energy-related benefits can be achieved as a result of the formation of this type of hydrogen ion concentration difference, leading to a reduced cell voltage.

In terms of factors such as, for example, reducing the cell voltage, the alkaline anode solution may be an aqueous solution with a pH of 12 or higher. In terms of, for example, facilitating the formation of a hydrogen ion concentration difference, thus leading to a reduction in the cell voltage, the ion-conductive polymer membrane 14 may be an anion-conductive membrane.

EXAMPLES

The present disclosure is described below in specific detail using a series of examples and comparative examples, but the present disclosure is not limited to the following examples.

Example 1

[Cathode Electrode]

Following mixing of 1 mg of a cobalt phthalocyanine complex catalyst having a chemical structure represented by formula (1) shown above (cobalt tetrapyridino-porphyrazine, hereafter abbreviated as Co(PyPc)) and 30 mg of a carbon material (Vulcan (a registered trademark) XC-72), the mixture was subjected to ultrasonic dispersion in a dimethylformamide solution. Subsequently, following stirring of the solution overnight, the solution was filtered to complete preparation of a carbon material having Co(PyPc) supported thereon (hereafter abbreviated as Co(PyPc)/C). Next, 10 mg of this Co(PyPc)/C and 5 mg of the alkali metal salt potassium triflate (hereafter abbreviated as KOtf) were dispersed in an ethanol/Nafion mixed solution, and 300 μL of the resulting solution was coated onto a 1.13 $cm^2$ microporous layer-containing carbon paper (GDS3250, manufactured by Avcarb LLC) used as a gas diffusion layer and then dried at 60° C.

[Anode Electrode]

Fe was supported on nickel foam by dipping the nickel foam in a 50 mM $FeCl_3$ aqueous solution and then heating the nickel foam at 300° C. in air in a muffle furnace. Subsequently, following electrolysis in a 1 M KOH aqueous solution for one hour, the nickel foam was cut to a size of 1.13 $cm^2$. This cut nickel foam sample was used as the anode electrode.

[Gas Diffusion Electrolytic Flow Cell]

An anion-conductive resin (Sustainion (a registered trademark) X37-50 grade) was sandwiched between the anode electrode and the cathode electrode. The cathode electrode was positioned so that the Co(PyPc) contacted the anion-conductive resin. This membrane/electrode assembly was sandwiched between a stainless steel cathode gas collector in which a gas flow channel had been formed and a titanium anode collector in which an anode solution flow channel had been formed. The cathode collector and the anode collector were positioned so that the gas flow channel and the anode solution flow channel contacted the membrane/electrode assembly. This completed a gas diffusion electrolytic flow cell.

[Carbon Dioxide Electrolysis]

Carbon dioxide electrolysis was conducted using the gas diffusion electrolytic flow cell described above. Specifically, carbon dioxide gas was supplied to the gas flow channel at a flow rate of 100 mL/min, a 1 M potassium hydroxide aqueous solution was supplied to the anode solution flow channel at a rate of 100 mL/min, a potentiostat was connected to the anode side and the cathode side using the two-electrode technique, and carbon dioxide electrolysis was conducted by constant current electrolysis. The carbon dioxide electrolysis was conducted with the current density set to 10, 50 or 100 mA/$cm^2$, and the voltage-time relationship was measured in each case.

Example 2

With the exceptions of using a cobalt phthalocyanine complex catalyst having a chemical structure represented by formula (2) shown above (hereafter abbreviated as Co(Pc)) instead of Co(PyPc), and using a nickel foam as the anode electrode, testing was conducted in the same manner as Example 1.

Example 3

With the exceptions of using sodium triflate (hereafter abbreviated as NaOtf) instead of KOtf, and conducting the constant current electrolysis at a current density of 50 mA/$cm^2$, testing was conducted in the same manner as Example 1.

Example 4

With the exception of using potassium nonafluorobutanoate ($K(C_4F_9SO_3)$) instead of KOtf, testing was conducted in the same manner as Example 1.

Example 5

[Cathode Electrode]

A metal complex polymer solution was prepared by dissolving 11.6 mg (14.7 mmol) of a complex catalyst having a chemical structure represented by formula (3) shown above [Mn{4,4'-di(1H-1-pyrrolyl-3-propyl carbonate)-2,2'-bipyridine}$(CO)_3(CH_3CN)$]$(PF_6)$ in 1.58 mL of acetonitrile, and then adding 33 μL of a 0.5 vol % pyrrole acetonitrile solution and 154 μL of a 0.2 M $FeCl_3$ ethanol solution. Subsequently, 16.5 mg of a carbon material (Vulcan (a registered trademark) XC-72), 68.8 μL of a Nafion 117 alcohol-water mixed solution (manufactured by Aldrich Co., Ltd.) and 5 mg of KOtf were added, and the mixture was then subjected to ultrasonic dispersion. An operation in which 41 μL of the resulting suspension was dripped onto a 1.13 $cm^2$ microporous layer-containing carbon paper (GDS3250, manufactured by Avcarb LLC) used as a gas diffusion layer and then dried at 60° C. was repeated 10 times. The resulting electrode was left to stand in the dark for at least 12 hours, and was then washed with water.

With the exceptions of using the cathode electrode prepared above and conducting the constant current electrolysis at a current density of 10 mA/$cm^2$, testing was conducted in the same manner as Example 1.

Comparative Example 1

With the exception of not using the KOtf, a cathode electrode was produced in the same manner as Example 1, and testing was then conducted in the same manner as Example 1.

Comparative Example 2

With the exceptions of producing the cathode electrode without using the Co(PyPc), and setting the cell voltage to −1.9 V, testing was conducted in the same manner as Example 1.

Comparative Example 3

With the exception of not using the KOtf, testing was conducted in the same manner as Example 2.

Comparative Example 4

With the exception of not using the KOtf, testing was conducted in the same manner as Example 5.

Figure 2:
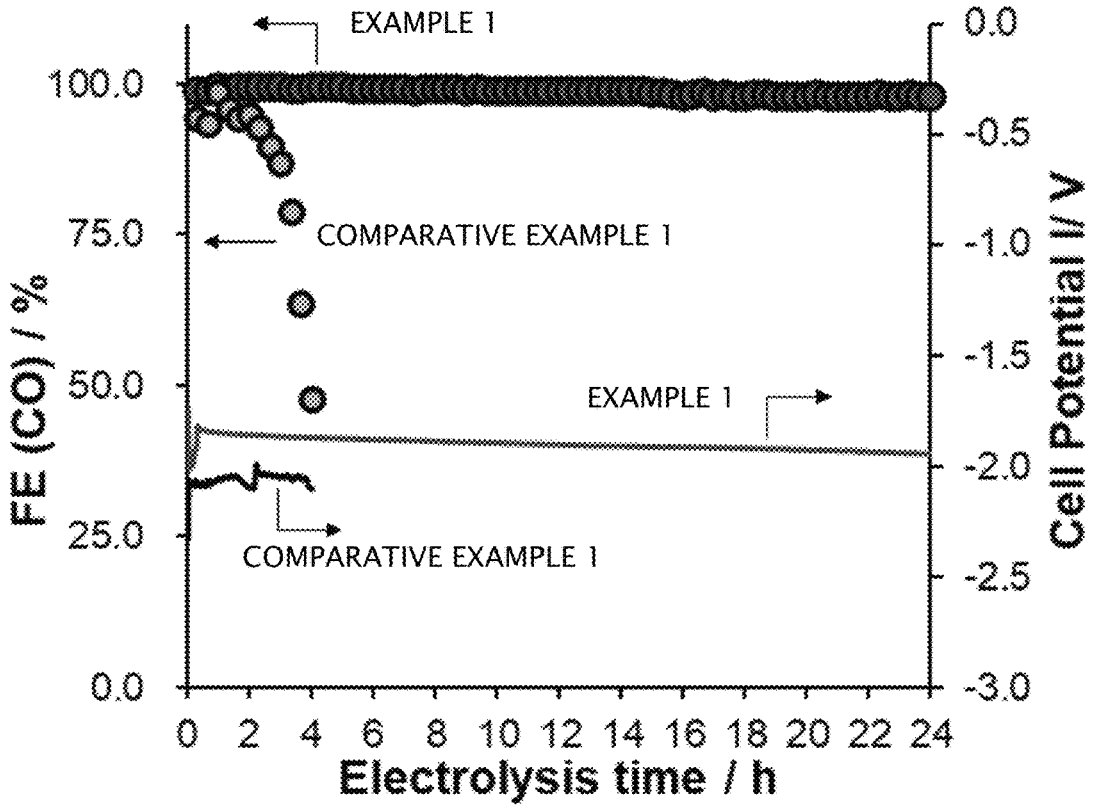
FIG. 2 is a diagram illustrating the change over time in the Faradaic efficiency of CO production and the cell potential in the carbon dioxide electrolysis of Example 1 and Comparative Example 1.

FIG. 2 illustrates the change over time in the Faradaic efficiency of CO production and the cell potential in the carbon dioxide electrolysis of Example 1 and Comparative Example 1. As illustrated in FIG. 2, in Example 1, the Faradaic efficiency of CO production (FE(CO)) was maintained at a high level for 24 hours, whereas in Comparative Example 1, the Faradaic efficiency of CO production (FE(CO)) began to decline almost immediately, and fell to about 50% after four hours. Further, the cell potential required to achieve a current of 100 mA/$cm^2$ was about −1.9 V in Example 1, but was about −2.1 V in Comparative Example 1. Based on these results, it was evident that compared with Comparative Example 1 in which no potassium salt was added, Example 1 in which a potassium salt was added as an alkali metal salt exhibited improved durability for the catalyst, and was able to achieve CO production at a lower cell potential.

Figure 3:
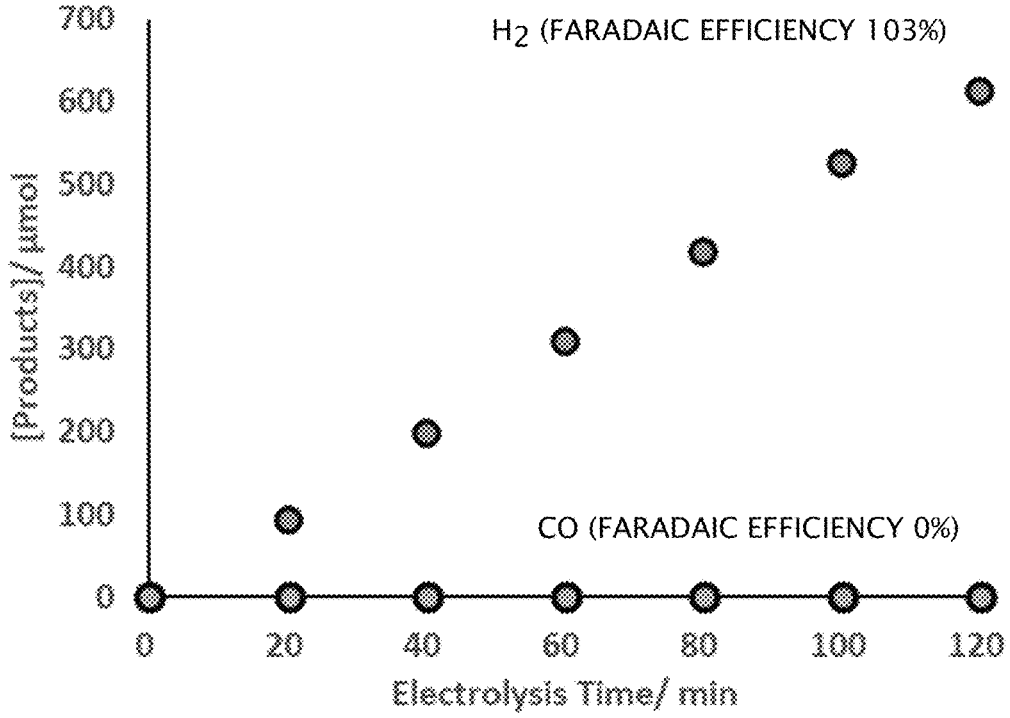
FIG. 3 is a diagram illustrating the change over time in the amount of product produced in the carbon dioxide electrolysis of Comparative Example 2.

FIG. 3 illustrates the change over time in the amount of product produced in the carbon dioxide electrolysis of Comparative Example 2. As illustrated in FIG. 3, in Comparative Example 2, in which a metal complex catalyst was not used, only hydrogen was produced in the carbon dioxide hydrolysis, and no CO was produced. This indicates that the CO produced in the carbon dioxide electrolysis of the aforementioned Example 1 was due to the metal complex catalyst.

Figure 4:
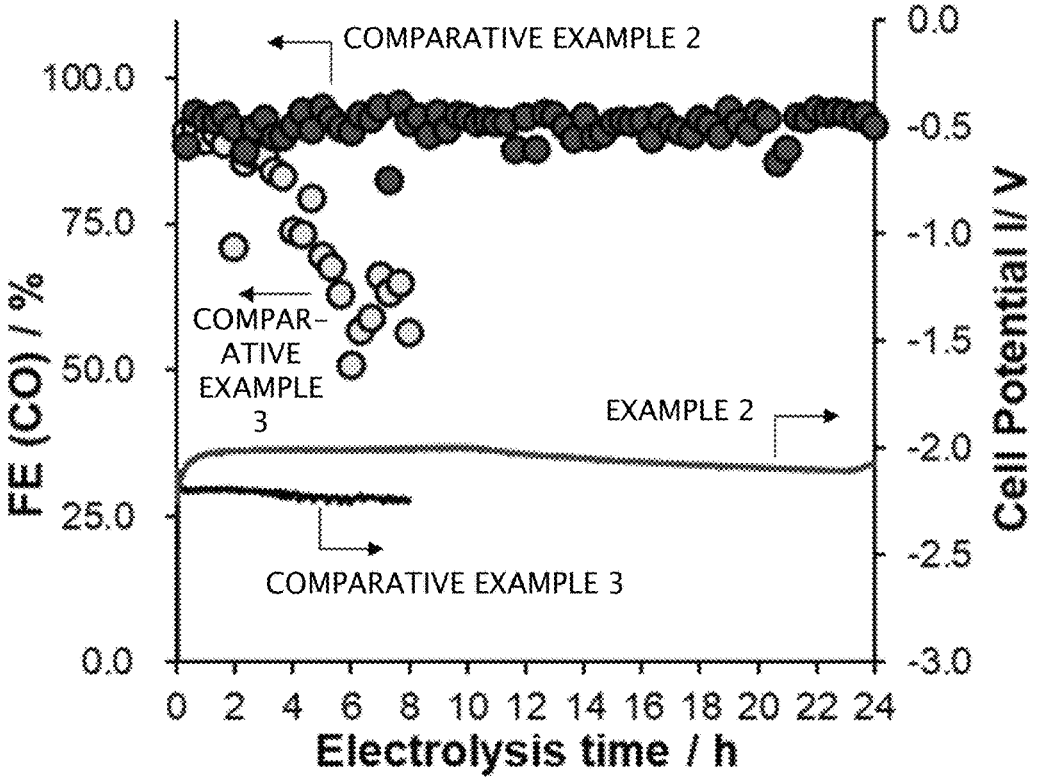
FIG. 4 is a diagram illustrating the change over time in the Faradaic efficiency of CO production and the cell potential in the carbon dioxide electrolysis of Example 2 and Comparative Example 3.

FIG. 4 illustrates the change over time in the Faradaic efficiency of CO production and the cell potential in the carbon dioxide electrolysis of Example 2 and Comparative Example 3. As illustrated in FIG. 4, In Example 2, the Faradaic efficiency of CO production (FE(CO)) was maintained at a high level for 24 hours, whereas in Comparative Example 3, the Faradaic efficiency of CO production (FE(CO)) began to decline almost immediately, and fell to about 50% after 8 hours. Further, the cell potential required to achieve a current of 100 mA/cm$^2$ was about −2.1 V in Example 2, but was about −2.3 V in Comparative Example 3. Based on these results, it was evident that, although Example 2 and Comparative Example 3 used a different catalyst from Example 1, compared with Comparative Example 3 in which no potassium salt was added, Example 2 in which a potassium salt was added as an alkali metal salt exhibited improved durability for the catalyst, and was able to achieve CO production at a lower cell potential.

Figure 5:
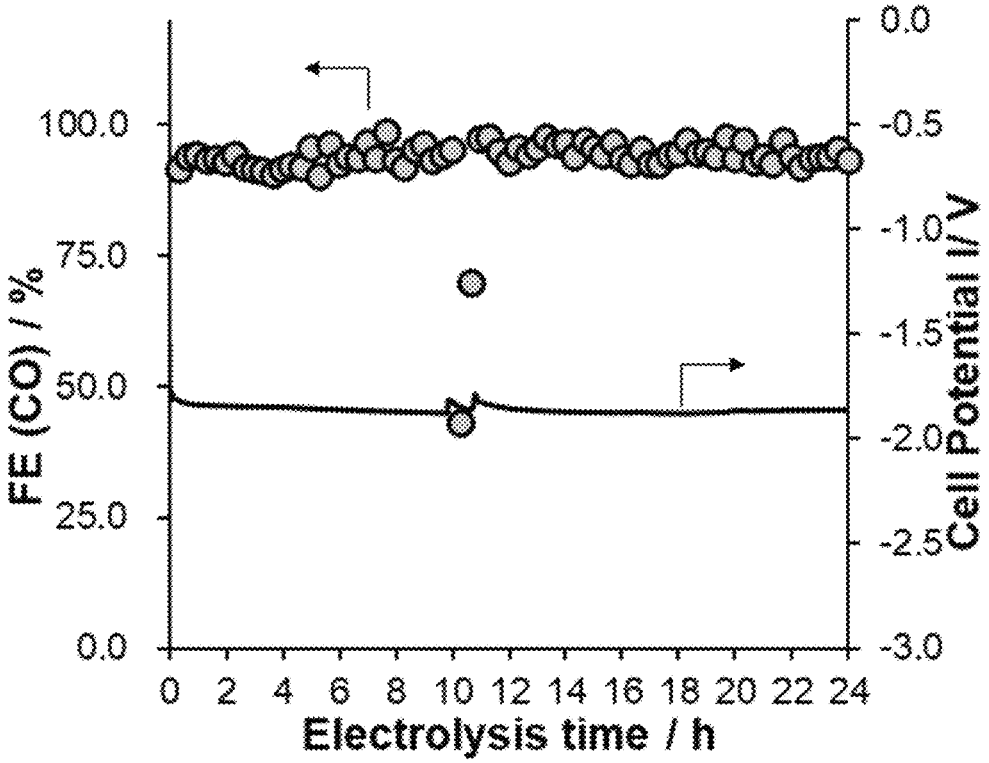
FIG. 5 is a diagram illustrating the change over time in the Faradaic efficiency of CO production and the cell potential in the carbon dioxide electrolysis of Example 3.

FIG. 5 illustrates the change over time in the Faradaic efficiency of CO production and the cell potential in the carbon dioxide electrolysis of Example 3. As illustrated in FIG. 5, in Example 3, the Faradaic efficiency of CO production (FE(CO)) was maintained at a high level for 24 hours. Further, the cell potential required to achieve a current of 50 mA/cm$^2$ was about −1.8 V Based on these results, it was evident that even in Example 3 in which a sodium salt was added as the alkali metal salt, CO was able to be produced at a low cell potential.

Figure 6:
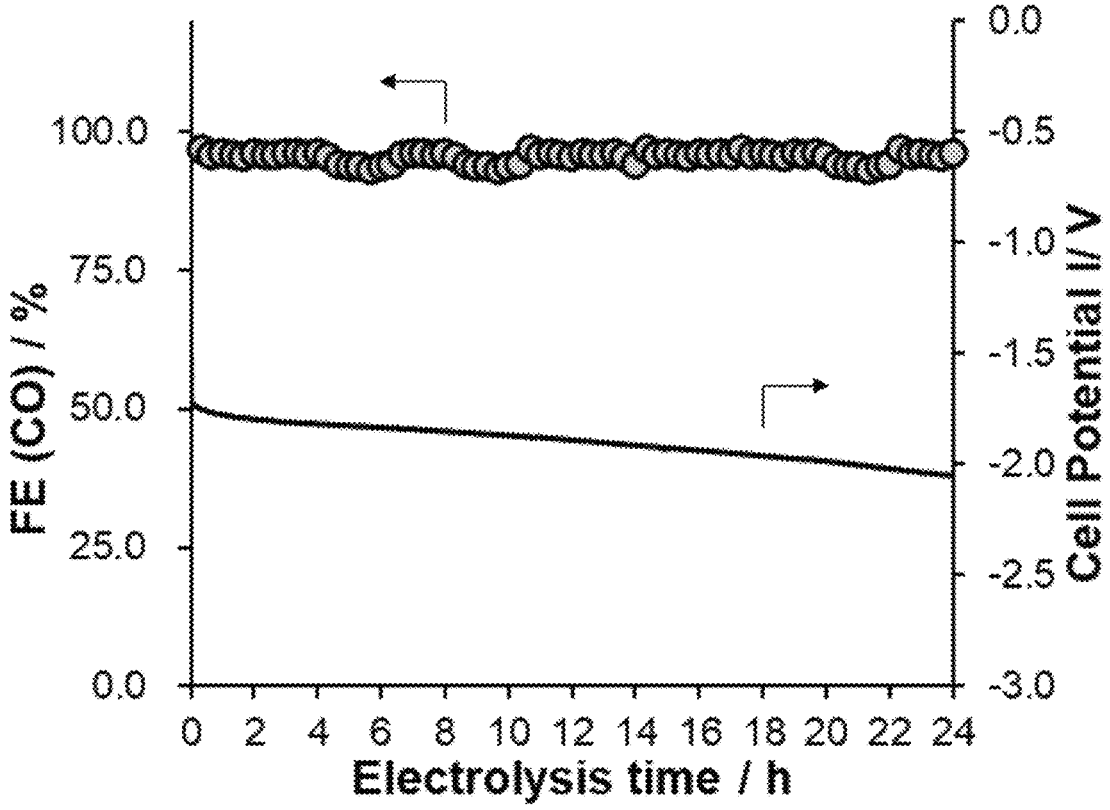
FIG. 6 is a diagram illustrating the change over time in the Faradaic efficiency of CO production and the cell potential in the carbon dioxide electrolysis of Example 4.

FIG. 6 illustrates the change over time in the Faradaic efficiency of CO production and the cell potential in the carbon dioxide electrolysis of Example 4. As illustrated in FIG. 6, in Example 4, the Faradaic efficiency of CO production (FE(CO)) was maintained at a high level for 24 hours. Further, the cell potential required to achieve a current of 100 mA/cm$^2$ was about −2.0 V Based on these results, it was evident that even in Example 4 in which potassium nonafluorobutanoate ($K(C_4F_9SO_3)$) was added as the potassium salt, CO was able to be produced at a low cell potential.

Figure 7:
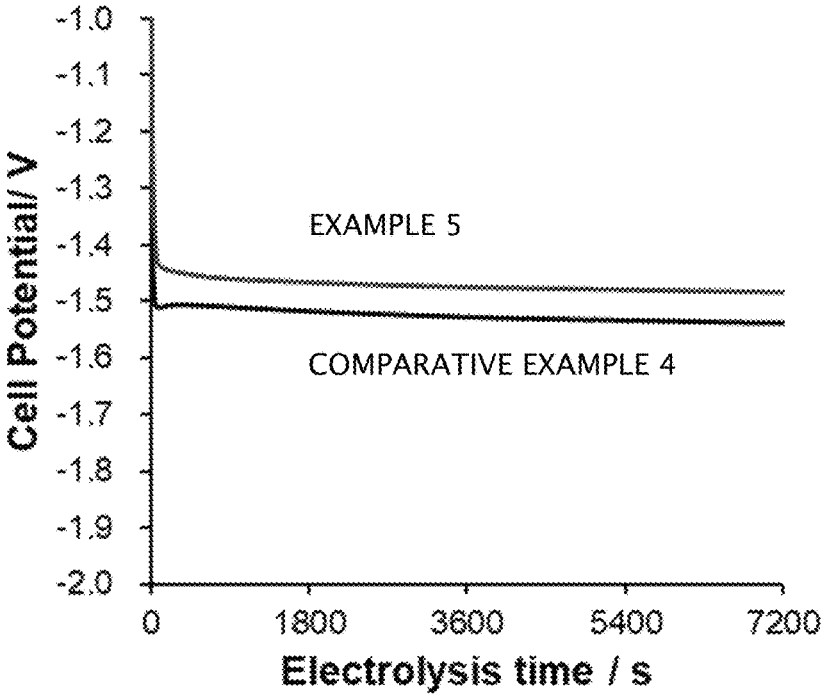
FIG. 7 is a diagram illustrating the change over time in the cell potential in the carbon dioxide electrolysis of Example 5 and Comparative Example 4.
Figure 8:
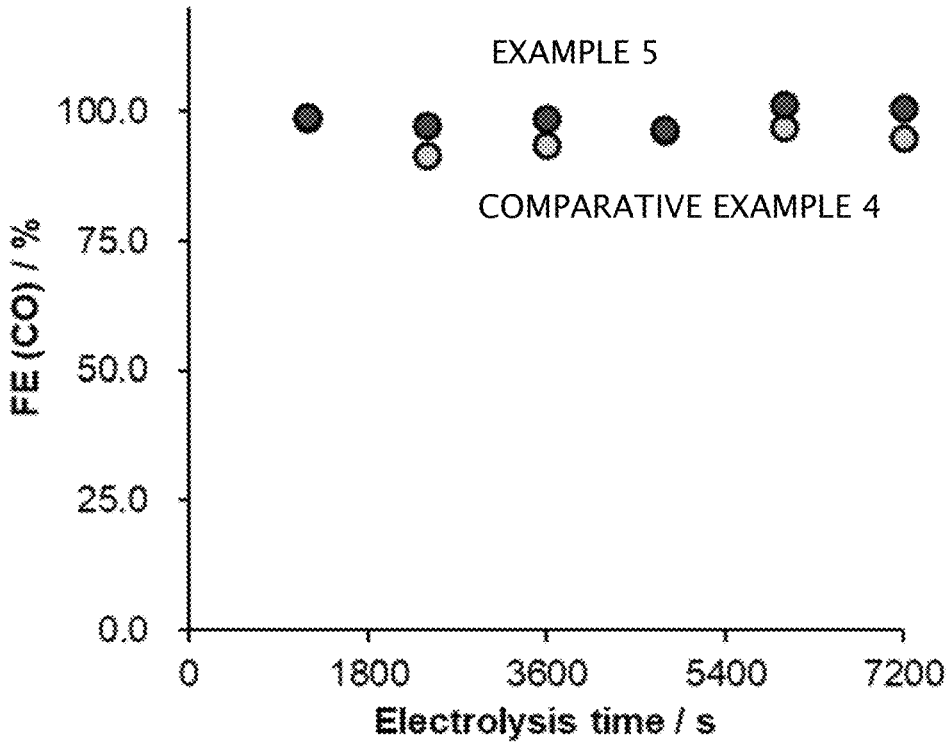
FIG. 8 is a diagram illustrating the change over time in the Faradaic efficiency of CO production in the carbon dioxide electrolysis of Example 5 and Comparative Example 4.

FIG. 7 is illustrates the change over time in the cell potential in the carbon dioxide electrolysis of Example 5 and Comparative Example 4, and, FIG. 8 illustrates the change over time in the Faradaic efficiency of CO production in the carbon dioxide electrolysis of Example 5 and Comparative Example 4. As illustrated in FIG. 7 and FIG. 8, compared with Comparative Example 4, in which a Mn complex catalyst was used, but no potassium salt was added as an alkali metal salt, Example 5 in which a Mn complex catalyst was used, and a potassium salt was added as an alkali metal salt, was able to achieve CO production at a lower cell potential.

The invention claimed is:

1. A cathode electrode for a gas diffusion electrolytic flow cell that produces a carbon dioxide reduction product by reducing carbon dioxide gas, wherein the cathode electrode comprises a catalyst layer having a metal complex catalyst, a carbon material and a solid alkali metal salt, and a gas diffusion layer disposed on the catalyst layer, wherein the alkali metal salt in the catalyst layer exists in a solid state even during the reduction of carbon dioxide.

2. The cathode electrode for the gas diffusion electrolytic flow cell according to claim 1, wherein the alkali metal salt comprises a potassium salt.

3. The cathode according to claim 1, wherein the metal complex catalyst is selected from the group consisting of the following formulae (1), (2) and (3):

(1)

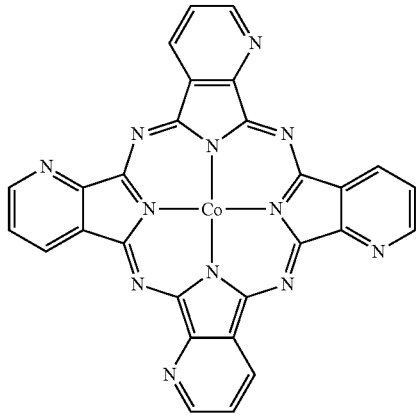

(2)

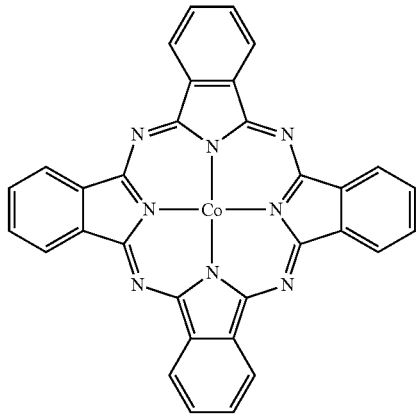

-continued (3)

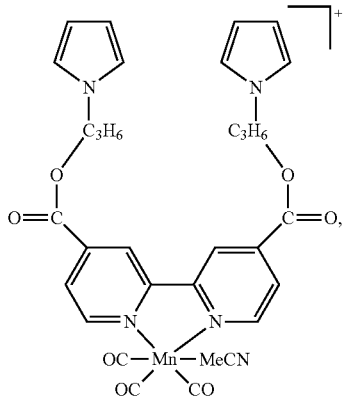

and the alkali metal salt is a triflate or a nonafluorobutanoate.

4. A gas diffusion electrolytic flow cell comprising an anode electrode that produces oxygen by oxidizing water or hydroxide ions, a cathode electrode that produces a carbon dioxide reduction product by reducing carbon dioxide gas, and an ion-conductive polymer membrane that is sandwiched between the anode electrode and the cathode electrode, wherein the cathode electrode comprises a catalyst layer and a gas diffusion layer in that order from a side of the ion-conductive polymer membrane, and the catalyst layer has a metal complex catalyst, a carbon material and a solid alkali metal salt, wherein the alkali metal salt in the catalyst layer exists in a solid state even during the reduction of carbon dioxide.

5. The gas diffusion electrolytic flow cell according to claim 4, wherein the alkali metal salt comprises a potassium salt.

6. The gas diffusion electrolytic flow cell according to claim 4, wherein the metal complex catalyst is selected from the group consisting of the following formulae (1), (2) and (3):

(1)

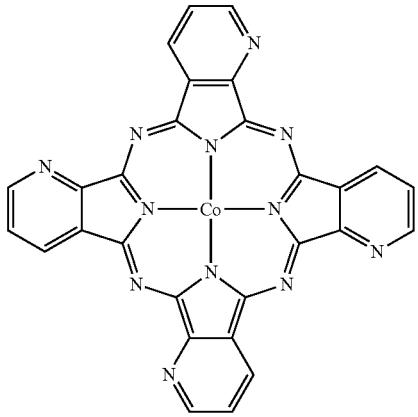

-continued (2)

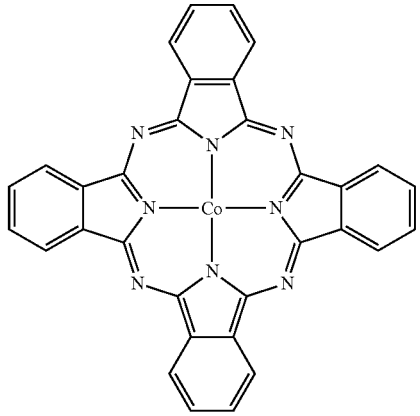

(3)

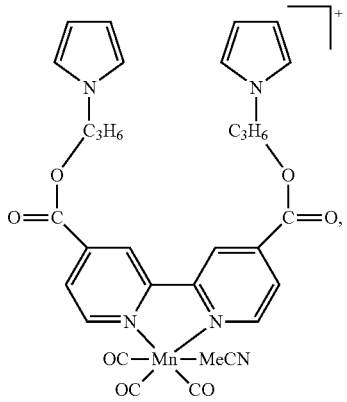

and the alkali metal salt is a triflate or a nonafluorobutanoate.

* * * * *